US006306802B1

(12) United States Patent
Shaub

(10) Patent No.: US 6,306,802 B1
(45) Date of Patent: Oct. 23, 2001

(54) MIXED ANTIOXIDANT COMPOSITION

(75) Inventor: Harold Shaub, Berkeley Heights, NJ (US)

(73) Assignee: Exxon Chemical Patents Inc., Linden, NJ (US)

( * ) Notice: Subject to any disclaimer, the term of this patent is extended or adjusted under 35 U.S.C. 154(b) by 0 days.

(21) Appl. No.: 08/837,735

(22) Filed: Apr. 22, 1997

Related U.S. Application Data

(63) Continuation of application No. 08/542,764, filed on Oct. 13, 1995, now abandoned, which is a continuation of application No. 08/315,381, filed on Sep. 30, 1994, now abandoned.

(51) Int. Cl.[7] ..... C10M 135/14
(52) U.S. Cl. ..... 508/364
(58) Field of Search ..... 508/363, 364

(56) References Cited

U.S. PATENT DOCUMENTS

| | | | | |
|---|---|---|---|---|
| 2,744,069 | | 5/1956 | van Loon | 252/40.7 |
| 3,087,436 | | 4/1963 | Dettlof et al. | 103/130 |
| 3,087,936 | | 4/1963 | LeSuer | 260/326.3 |
| 3,150,088 | | 9/1964 | Hunt et al. | 252/32.7 |
| 3,150,089 | | 9/1964 | Hunt | 252/33 |
| 3,172,892 | | 3/1965 | LeSuer et al. | 260/326.5 |
| 3,215,707 | | 11/1965 | Rense | 260/326.3 |
| 3,231,587 | | 1/1966 | Rense | 260/346.8 |
| 3,254,025 | | 5/1966 | LeSuer | 252/32.7 |
| 3,272,746 | | 9/1966 | LeSuer et al. | 252/47.5 |
| 3,356,702 | * | 12/1967 | Farmer et al. | 252/42.7 |
| 3,361,673 | | 1/1968 | Stuart et al. | 252/51.5 |
| 3,381,022 | | 4/1968 | LeSuer | 260/404.8 |
| 3,401,118 | | 9/1968 | Benoit, Jr. | 252/51.5 |
| 3,595,791 | | 7/1971 | Cohen | 252/33.6 |
| 3,649,229 | | 3/1972 | Otto | 44/73 |
| 3,704,315 | | 11/1972 | Amsterdam | 260/521 R |
| 3,912,764 | | 10/1975 | Palmer, Jr. | 260/346.8 |
| 4,098,705 | | 7/1978 | Sakurai et al. | 252/33.6 |
| 4,102,798 | | 7/1978 | Ryer et al. | 252/51.5 |
| 4,110,349 | | 8/1978 | Cohen | 260/346.74 |
| 4,113,639 | | 9/1978 | Lonstrup | 252/51.5 |
| 4,116,876 | | 9/1978 | Brois et al. | 252/49.6 |
| 4,234,435 | | 11/1980 | Meinhardt et al. | 252/51.5 |
| 4,265,773 | * | 5/1981 | de Vries et al. | 252/46.4 |
| 4,285,882 | | 8/1981 | Kramer et al. | 260/463 |
| 4,369,119 | | 1/1983 | deVries et al. | 252/42.7 |
| 4,370,246 | * | 1/1983 | de Vries et al. | 252/46.4 |
| 4,394,279 | * | 7/1983 | de Vries et al. | 252/46.4 |
| 4,692,256 | * | 9/1987 | Umemura et al. | 252/32.7 E |
| 4,846,983 | | 7/1989 | Ward, Jr. | 252/33.6 |
| 5,356,547 | * | 10/1994 | Arai et al. | 252/46.4 |

FOREIGN PATENT DOCUMENTS

| | | |
|---|---|---|
| 0024146 | 2/1981 | (EP) . |
| 0205165 | 12/1986 | (EP) . |
| 984409 | 2/1965 | (GB) . |
| 1440219 | 6/1976 | (GB) . |

OTHER PUBLICATIONS

"The Synthesis of Di—thio–dithio–is(dialkyldithiocarbamates) Dimolybdenum (V) and Their Effects on Boundary Lubrication" Bull. Jap. Petrol. Inst. 1971 (13)2, pp. 243–249.

Angew. Chem. Int. Ed. Engl. 17 (1978) No. 4 pp. 279–280.

J. Am. Chem. Soc. 1980, vol. 102, No. 15, pp. 5102–5104.

* cited by examiner

*Primary Examiner*—Margaret Medley
*Assistant Examiner*—Cephia D. Toomer

(57) ABSTRACT

The combination of a molybdenum compound and an aromatic amine has been found to produce a synergistic antioxidant effect when used as an antioxidant additive for lubricating oils. The combination has been found to be particularly effective under catalytic oxidation conditions, e.g. Fe catalysed oxidation of crankcase lubricating oils.

16 Claims, No Drawings

MIXED ANTIOXIDANT COMPOSITION

This is a continuation, of application Ser. No. 08/542,764 filed on Oct. 13, 1995 which is a continuation of application Ser. No. 08/315,381 filed on Sep. 30, 1994, both abandoned.

BACKGROUND OF THE INVENTION

This invention relates to lubricating oil additives, and to lubricating oil compositions and concentrates prepared therefrom. More specifically it relates to an additive containing a combination of a molybdenum compound and an aromatic amine compound as an antioxidant.

DESCRIPTION OF THE PRIOR ART

Lubricating oils as used in, for example, the internal combustion engines of automobiles or trucks are subjected to a demanding environment during use. This environment results in the oil suffering oxidation which is catalysed by the presence of impurity species in the oil such as iron compounds and is also promoted by the elevated temperatures experienced by the oil during use. This catalysed oxidation of the oil contributes to the formation of corrosive oxidation products and sludge in the oil but can also cause the viscosity of the oil to increase or even cause the oil to solidify. This oxidation of lubricating oils during use is usually controlled to some extent by the use of antioxidant additives which may extend the useful life of the oil particularly by reducing or preventing unacceptable viscosity increases.

There is, however, a continuing need for new antioxidants and antioxidant systems which offer improved performance and which are effective at low levels. There are a number of factors which have contributed to this continuing need. One such factor is that in recent years internal combustion engines are often operated at higher temperatures which tends to increase the rate of oxidation and so shorten the useful life of the oil. In addition there is a strong desire to use cheaper base stocks for lubricating oil compositions which have inferior resistance to oxidation and require more efficient and effective antioxidants. There is also a need for lubricating oils to have a longer in service life span due to the service intervals for motor vehicles becoming longer. There is also a desire to find antioxidants and antioxidant systems which meet the above requirements and at the same time are not detrimental to other aspects of motor vehicle performance. In this respect there is a desire for antioxidants which do not contribute to the phosphorus content of motor vehicle exhausts as phosphorus is detrimental to the performance of catalyst based exhaust purification systems. In addition some antioxidants such as for example diphenylamines cannot be used at relatively high concentrations as this may result in sedimentation or deposits in hot engine areas such as the diesel ring areas in diesel engines. The invention is concerned with the problem of providing an improved antioxidant for use in lubricating oils.

We have now discovered that a combination of certain molybdenum containing compounds and certain aromatic amines is a highly effective regenerative antioxidant system for use in lubricating oils and especially in lubricating oils for gasoline and diesel engines.

There have been a number of proposals for the use of molybdenum compounds as antioxidants for lubricating oils such as those described in U.S. Pat. No. 3,356,702, U.S. Pat. No. 4,098,705, U.S. Pat. No. 4,265,773, U.S. Pat. No. 4,285,882, U.S. Pat. No 4,369,119, U.S. Pat. No. 4,370,246, U.S. Pat. No. 4,394,279, U.S. Pat. No. 4,846,983 and EP 0,205,165. Both U.S. Pat. No. 4,370,246 and U.S. Pat. No. 4,394,279 describe the use of combinations of specific molybdenum compounds with aromatic amines wherein the molybdenum compounds are prepared from the reaction of an acidic molybdenum compound with a basic nitrogen compound selected from either Mannich bases phosphonamides, thiophosphonamide, phosphoramide, succinamide, carboxylic acid amide, dispersant viscosity index improvers or mixtures thereof and either carbon disulfide or other sulphur containing compounds.

SUMMARY OF THE INVENTION

According to the present invention there is provided a lubricating oil additive which comprises a combination of an oil-soluble molybdenum containing and of general formula I:

I

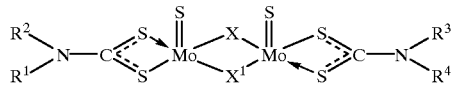

wherein $R^1$, $R^2$, $R^3$ and $R^4$ may be the same or different and each independently represent a $C_7$ to $C_{24}$ hydrocarbyl radical, X and $X^1$ may be the same or different and independently represent S or O, and the Mo is in oxidation state five or less; and at least one oil-soluble aromatic amine.

By the term hydrocarbyl radical is meant an organic moiety which comprises hydrogen and carbon and which unless the context states otherwise may be aliphatic (including alicyclic), aromatic or a combination thereof. It may be substituted or unsubstituted, alkyl, aryl or alkaryl and may optionally contain unsaturation or heteroatoms such as O, N or S. It is preferred that the hydrocarbyl radical does not contain heteroatom substitution. It is preferred that the hydrocarbyl radical is a hydrocarbyl radical of $C_{10}$ to $C_{18}$ and most preferably is a $C_{12}$ aliphatic hydrocarbyl radical. Examples of suitable aliphatic hydrocarbyl radicals include, 2-ethyihexyl, nonylphenyl, dodecyl, pentyl, cyclohexyl, phenylmethyl, methyl, ethyl, n-propyl, isopropyl, n-butyl, or t-butyl. The choice of $R^1$, $R^2$, $R^3$ and $R^4$ must be such that the resulting molybdenum compound of general structure I is oil-soluble.

It is preferred that X and $X^1$ are the same. It is most preferred that X and $X^1$ are S.

By the term aromatic amine is meant any secondary amine with at least one aromatic group; such an amine gives a synergistic antioxidant effect when used in combination with a molybdenum compound of general formula I.

It is preferred that the oil-soluble secondary aromatic amines are diphenylamines of general formula II:

II

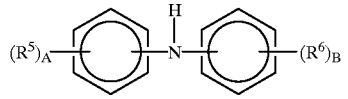

wherein $R^5$ and $R_6$ may be the same or different and each independently represents a hydrocarbyl radical as hereinbefore defined. It is preferred that $R^5$ and $R^6$ are $C_1$ to $C_{28}$ aliphatic hydrocarbyl radicals. A and B may be the same or different and may equal 0, 1, 2 or 3. It is preferred that A and B are the same and that they equal 1. It is also preferred that the diphenylamines have a nitrogen content of between 2.5 and 5% by weight. It is preferred that $R^5$ and $R^6$ are located in the meta or para positions relative to the amino substitution in the aromatic rings of the diphenylamines. Examples of suitable diphenylamines include di-octyidiphenylamine, t-pentyldiphenylamine, diisobornyidiphenyiamine, didecyidiphenylamine, didodecyldiphenylamine, dihexyldiphenylamine, di-t-butyidiphenylamine, di-t-octyldiphenylamine, dinonylamine, dibutyldiphenylamine, distyryidiphenylamine. Other suitable diphenylamines include di-substituted derivatives wherein the $R^5$ and $R^6$ are different and independently represent hydrocarbyl radicals such as for example t-butyl, t-octyl, styryl, n-butyl or n-octyl. Some of these diphenylamines are commercially available and are sold under the trademarks, Vanlube DND, Naugalube 438L, Pearsall OA502, Lubrizol 5150A, Vanlube SL, Naugalube 680, Inganox L-57 and Vanlube 848. Vanlube DND, Naugalube 438L, Pearsall OA502 and Lubrizol 5150A nominally have structures as represented by general formula II wherein $R^5$ and $R^6$ are $C_9$ hydrocarbyl groups and A=B=1. Vanlube SL and Naugalube 680 nominally have structures as represented by general formula II wherein $R^5$ and $R^6$ are either one of $C_4$, $C_8$ or styryl hydrocarbyl groups and A=B=1; these are mixed diphenyl amines. Irganox L-57 and Vanlube 848 nominally have structures as represented by general formula II wherein $R^5$ and $R^6$ are either one of t-butyl or t-octyl groups and A=B=1.

Some of the oil-soluble molybdenum compounds of Formula I are commercially available. For example products where X and $X^1$ are O and where $R^1$, $R^2$, $R^3$ and $R^4$ are $C_{13}H_{27}$ aliphatic hydrocarbyl groups and where the molybdenum is in oxidation state V are sold under the trademarks Molyvan 807 and Molyvan 822 as antioxidants and friction reducing additives by R.T. Vanderbilt Company Inc. Norwalk Conn. USA. These molybdenum compounds may be prepared by the methods described in U.S. Pat. No. 3,356,702 wherein $MoO_3$ is converted to soluble molybdate by dissolving in alkali metal hydroxide solution, neutralised by the addition of acid followed by the addition of a secondary amine and carbon disulfide.

The molybdenum compounds of general structure I wherein X and $X^1$ are S may be prepared by a number of methods. JP 51080825 (Asahi Denka Kogyo K.K.) discloses a method wherein $MoS_3$, secondary amine and $CS_2$ are reacted together in an inert organic solvent. Bull. Jap. Petrol. Inst. 1971, 13(2), 243–9 discloses a method wherein sulfurized molybdenum dialkyl- dithiocarbamates prepared according to U.S. Pat. No. 3,356,702 are treated in xylene solution with $P_2S_5$ with heating followed by the dissolving in DMF of the resulting precipitate with further heating. J.Am.Chem.Soc., Vol 102, No. 15 1980, 5102–4 discloses a method wherein polynuclear molybdenum complexes of structure III

III

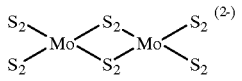

prepared by the method disclosed in Angew. Chem., Int. Ed. Engi., 17, 279 (1978), are refluxed in $CH_3OH$ with 20 equivalents of $Na(S_2CN(C_2H_5)_2)$ for two hours.

Although it is not understood how the molybdenum compounds of general structure I co-operate with the aromatic amines to produce a synergistic antioxidant effect it is believed that the mechanism may involve a regenerative process. It is believed that during oxidation of the oil, oxidation intermediates oxidise the molybdenum compound to a higher oxidation state. It is then believed that the aromatic amine is able to interact with the higher oxidation state molybdenum compound reducing it so that the original molybdenum compound of lower oxidation state is regenerated with the diphenylamine being converted to a quinone intermediate. It is necessary therefore if the above mechanism is correct that the molybdenum compound is in oxidation state five or less so that the molybdenum can be oxidised to a higher oxidation state. It is also necessary that the redox potential of the higher oxidation state molybdenum compound and the diphenylamine are such that the higher oxidation state molybdenum compound can be reduced to a lower oxidation state.

It is also envisaged that mixtures of molybdenum compounds of general formula I may be used and/or mixtures of oil-soluble aromatic amines may be used as the lubricating oil additive of the present invention.

Also provided by the invention is the use as a lubricating oil antioxidant of a combination of an oil-soluble molybdenum containing compound of general formula I and at least one oil-soluble aromatic amine.

In another aspect the invention provides for a lubricating oil composition which comprises a lubricating oil and a lubricating oil additive comprising the combination of an oil-soluble molybdenum compound of general formula I and at least one oil-soluble aromatic amine. The concentration of the lubricating oil additive is typically in the range of 0.01 to about 15% by weight based on the total weight of the composition and is preferably from about 0.1 to about 7% by weight.

Suitable lubricating oils for use in preparing the lubricating composition include those oils which are conventionally employed as crankcase lubricating oils for internal combustion engines and those which may be employed as power transmitting fluids such as automatic transmission fluids, hydraulic fluids, or gear lubricants.

The lubricating oil may be a synthetic oil such as for example alkylesters of dicarboxylic acids, polyglycols and alcohols, polyalphaolefins, alkylbenzenes, organic esters of phosphoric acids, or polysilicone oils.

The lubricating oil may be a natural oil including mineral oils which may vary widely as to their crude source e.g. whether paraffinic, naphthenic or mixed paraffinic-naphthenic; as well as to their formation, e.g. distillation range, straight run or cracked, hydrorefined, or solvent extracted.

The invention further provides a lubricating oil concentrate. In the preparation of lubricating oil compositions it is a convenient practice to introduce additives in the form of a concentrate; which introduction may be made by methods known in the art. The lubricating oil concentrate may contain between 2.5 to 90 weight percent more preferably 5 to 75 weight percent of the additive composition in a suitable solvent. Suitable solvents may include hydrocarbon oils e.g. mineral lubricating oil or synthetic oil.

The ratio of Mo compound of general formula I to the oil-soluble aromatic amine may be selected so as to provide an antioxidant effect of sufficient magnitude to meet the end use requirements of the lubricating oil—for example, to achieve adequate performance in the Sequence III E engine test for crankcase lubricating oils (according to the procedure of ASTM STP315). Preferably the Mo compound of general formula I and the oil-soluble aromatic amine are employed in a ratio of from 1:10 to 10:1 (by wt), more preferably from 3:1 to 1:3 (by wt).

The lubricating oil additive may be used as the sole additive for the composition or concentrate or may be used in combination with several different types of additive which may be required to fulfill other requirements of the composition or concentrate during use. The composition may be used as a crankcase lubricating oil, a cylinder lubricant for applications such as marine diesel, industrial oil, functional fluid such as power transmission fluid, tractor oil, gear oil or hydraulic fluid. Accordingly the compositions or concentrates of the invention may in addition to the lubricating oil additive contain one or more of the following:

(a) a dispersant, preferably an ashless dispersant;

(b) a metal containing detergent, preferably having a high total base number;

(c) an antiwear or extreme pressure additive;

(d) a viscosity index improver, which may also have dispersant properties;

(e) a pour point depressant;

(f) a corrosion inhibitor and/or metal deactivator; and (g) a friction modifier or fuel economy agent, as well as other additives such as demulsifiers, seal swell agents, or even supplementary antioxidants.

Where such compositions are for use as crankcase lubricants they preferably contain at least; an ashless dispersant and/or a viscosity index improver dispersant, a detergent, and an antiwear additive in amounts effective to provide their respective functions.

Dispersants

The preferred ashless dispersant in the compositions and concentrates of this invention is a long chain hydrocarbyl substituted mono- or di-carboxylic acid material, i.e. acid, anhydride, or ester, and includes a long chain hydrocarbon, generally a polyolefin, substituted with an alpha or beta unsaturated $C_4$ to $C_{10}$ carboxylic acid material, such as itaconic acid, maleic acid, maleic anhydride, chloromaleic acid, dimethyl fumarate, chloromaleic anhydride, acrylic acid, methacrylic acid, crotonic acid, or cinnamic acid. Preferably, the dispersant contains at least about 1 mole (e.g. 1.05 to 1.2 moles, or higher) of the acid material per mole of polyolefin. The proportion of the dispersant is preferably from 1 to 10 and especially 3 to 7 weight percent of the lubricating oil.

Preferred olefin polymers for the reaction with carboxylir, acids are polymers derived from a $C_2$ to $C_5$ monoolefin. Such olefins include ethylene, propylene, butylene, isobutylene, pentene, oct-1-ene or styrene. The polymers may be homopolymers such as polyisobutylene or copolymers of two or more of such olefins. These include copolymers of: ethylene and propylene; butylene and isobutylene; propylene and isobutylene; etc. Other copolymers include those in which a minor molar amount of the copolymer monomers, e.g. 1 to 10 mole percent, is a $C_4$ to $C_{18}$ diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers usually have number average molecular weights above about 700, including number average molecular weights within the range of from 1,500 to 5,000 with approximately one double bond per polymer chain. An especially suitable starting material for a dispersant additive is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography," John Wiley and Sons, New York, 1979.

Processes for reacting the olefin polymer with the unsaturated carboxylic acid, anhydride, or ester are known in the art. For example, the olefin polymer and the carboxylic acid material may be simply heated together as disclosed in U.S. Pat. Nos. 3,361,673 and 3,401,118 to cause a thermal "ene" reaction to take place. Alternatively, the olefin polymer can be first halogenated, for example chlorinated or brominated, to about 1 to 8, preferably 3 to 7, weight percent chlorine or bromine, based on the weight of polymer, by passing chlorine or bromine through the polyolefin at a temperature of 100° to 250° C., e.g. 120° to 160° C., for about 0.5 to 10, preferably 1 to 7 hours. The halogenated polymer may then be reacted with sufficient unsaturated acid or anhydride at 100° to 250° C., usually 180° to 220° C., for from 0.5 to 10, e.g. 3 to 8 hours. Processes of this general type are taught in U.S. Pat. Nos. 3,087,436; 3,172,892; 3,272,746 cnd others.

Alternatively the olefin polymer, and the unsaturated acid or anhydride are mixed and heated while chlorine is added to the hot material. Processes of this type are disclosed in U.S. Pat. Nos. 3,215,707; 3,231,587; 3,912,764; 4,110,349; 4,234,435; and GB-A-1 440 219.

When a halogen is used, from 65 to 95 weight percent of the polyolefin normally reacts with the carboxylic acid or anhydride. Thermal reactions, carried out without the use of halogen or a catalyst, cause only from 50 to 75 weight percent of the polyisobutylene to react. Chlorination increases reactivity.

The carboxylic acid or anhydride can then be further reacted with amines, alcohols, including polyols, amino-alcohols, etc., to form other useful dispersant additives. Thus if the acid or anhydride is to be further reacted, e.g. neutralized, then generally a major proportion of at least 50 percent of the acid units up to all the acid units will be reacted.

Useful amine compounds for reaction with the hydrocarbyl substituted carboxyiic acid or anhydride include mono- and polyamines of from 2 to 60, e.g. 3 to 20, total carbon atoms and from 1 to 12, e.g. 2 to 8, nitrogen atoms in a molecule. These amines may be hydrocarbyl amines or may be hydrocarbyl amines including other groups, e.g. hydroxy groups, alkoxy groups, amide groups, nitriles, or imidazoline groups. Hydroxy amines with 1 to 6 hydroxy groups, preferably 1 to 3 hydroxy groups, are particularly useful. Preferred amines are aliphatic saturated amines, including those of the general formulae:

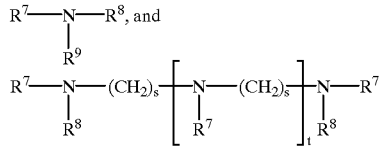

wherein $R^7$, $R^8$ and $R^9$ are each hydrogen; $C_1$ to $C_{25}$ straight or branched chain alkyl radicals; $C_1$ to $C_{12}$ alkoxy-($C_6$ alkylene) radicals; $C_2$ to $C_{12}$ alkylamino-$C_2$ to $C_6$ alkylene) radicals; each s can be the same or a different number of from 2 to 6, preferably 2 to 4; and t is a number from 0 to 10, preferably 2 to 7. At least one of $R^7$, $R^8$ and $R^9$ must be hydrogen.

Suitable amines include: 1,2-diaminoethane; 1,3-diaminopropane; 1,4-diaminobutane; 1,6-diaminohexane;

polyethylene amines such as diethylene triamine; triethylene tetramine; tetraethylene pentamine; polypropylene amines such as 1,2-propylene diamine; di-(1,2-propylene)triamine; di(1,3-propylene)-triamine; N,N-dimethyl-1 ,3-diaminopropane; N,N-di-(2-aminoethyl) ethylene diamine; N,N-di(2-hydroxyethyl)-1 ,3-propylene diamine; 3-dodecyloxypropylamine; N-dodecyl-1,3-propane diamine; tris hydroxymethylaminomethane (THAM); diisopropanol amine; diethanol amine; triethanol amine; amino morpholines such as N-(3-amino-propyl) morpholine; etc.

Other useful amine compounds include: alicyclic diamines such as 1,4-di-(aminomethyl) cyclohexane, and heterocyclic nitrogen compounds such as imidazolines, and N-aminoalkyl piperazines of the general formula:

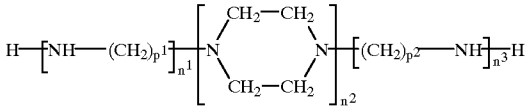

wherein $p^1$ and $p^2$ are the same or different and each is an integer from 1 to 4, and $n_1$, $n^2$ and $n^3$ are the same or different and each is an integer from 1 to 3. Examples of such amines include 2-pentadecyl imidazoline and N-(2-aminoethyl) piperazine.

Hydroxyamines which can be reacted with the long chain hydrocarbon substituted dicarboxylic acid material mentioned above to form dispersants include 2-amino-1-butanol, 2-amine-2-methyl-1 -propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxy propyi)N'-(beta-aminoethyl)-piperazine, ethanolamine and beta-(beta-hydroxyethoxy)-ethylamine. Mixtures of these or similar amines can also be employed. Commercial mixtures of amine compounds may advantageously be used. For example, one process for preparing alkylene amines involves the reaction of an alkylene dihalide (such as ethylene dichloride or propylene dichloride) with ammonia which results in a complex mixture of alkylene amines wherein pairs of nitrogens are joined by alkylene groups, forming such compounds as diethylene triamine, triethylene tetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

(i) $NH_2$-alkylene(O-alkylene)$_m$ $NH_2$ where m has a value of from 3 to 70, preferably 10 to 35; and (ii) R-(alkylene(O-alkylene)$_n$ $NH_2)_{3-6}$ where each n has a value of about 1 to 40, with the proviso that the sum of all the n's is from 3 to 70 and preferably from 6 to 35, and R is a saturated hydrocarbon radical of up to ten carbon atoms, wherein the number of substituents on the R group is from 3 to 6. The alkylene groups in either formula (i) or (ii) may be straight or branched chains containing about 2 to 7, and preferably about 2 to 4, carbon atoms.

The polyoxyalkylene polyamines above, preferably polyoxyalkylene diamines and polyoxyalkylene triamines, may have average molecular weights ranging from 200 to 4,000 and preferably from 400 to 2,000. The preferred polyoxyalkylene polyamines include the polyoxyethylene and polyoxypropylene diamines and the polyoxypropylene triamines having average molecular weights ranging from 200 to 2,000. The polyoxyalkylene polyamines are commercially available and may be obtained, for example, from the Jefferson Chemical Company, Inc. under the trade name "Jeffamines D-230, D400, D-1000, D-2000, T-403," etc.

The amine is readily reacted with the carboxylic acid material, e.g. alkenyl succinic anhydride, by heating an oil solution containing 5 to 95 weight percent of carboxylic acid material to from 100 to 250° C., preferably 125 to 175° C., generally for 1 to 10, e.g. 2 to 6 hours, until the desired amount of water has been removed. The heating is preferably carried out to favour formation of imides, or mixtures of imides and amides, rather than amides and salts. Reaction ratios can vary considerably, depending upon the reactants, amounts of excess amine, type of bonds formed, etc. Generally from 0.3 to 2, preferably from 0.3 to 1.0 e.g. 0.4 to 0.8, mole of amine, e.g. bis-primary amine, is used, per mole of the carboxylic acid moiety content, e.g. grafted maleic anhydride content. For example, one mole of olefin reacted with sufficient maleic anhydride to add 1.10 mole of maleic anhydride groups or mole of olefin when converted to a mixture of amides and imides, about 0.55 moles of amine with two primary groups would preferably be used, i.e. 0.50 mole of amine per mole of dicarboxylic acid moiety.

The nitrogen-containing dispersant can be further treated by boration as generally taught in U.S. Pat. Nos. 3,087,936 and 3,254,025.

Tris (hydroxymethyl) amino methane (THAM) can be reacted with the aforesaid acid material to form amides, imides or ester type additives as taught by GB-A-984 409, or to form oxazoline compounds and borated oxazoline compounds as described, for example, in U.S. Pat. Nos. 4,102,798, 4,116,876 and 4,113,639.

The ashless dispersants may also be esters derived from the long chain hydrocarbyl substituted carboxylic acid material and from hydroxy compounds such as monohydric and polyhydric alcohols or aromatic compounds such as phenols and naphthols, etc. The polyhydric alcohols are the most preferred hydroxy compound and preferably contain from 2 to 10 hydroxy radicals, for example, ethylene glycol, diethylene glycol, triethylene glycol, tetraethylene glycol, dipropylene glycol, and other alkylene glycols in which the alkylene radical contains from 2 to 8 carbon atoms. Other useful polyhydric alcohols include glycerol, mono-oleate of glycerol, monostearate of glycerol, monomethyl ether of glycerol, pentaerythritol, dipentaerythritol, etc.

The ester dispersant may also be derived from unsaturated alcohols such as allyl alcohol, cinnamyl alcohol, propargyl alcohol, 1-cyclohexane-3-ol, and oleyl alcohol. Still other classes of alcohols capable of yielding the esters comprise the ether-alcohols and amino-alcohols including, for example the oxy-alkylene, oxy-arylene-, amino-alkylene-, and amino-arylene-substituted alcohols having one or more oxy-alkylene, amino-alkylene or amino-arylene or amino-arylene oxy-arylene radicals. They are exemplified by Cellosolve, carbitol, N,N,N',N'-tetrahydroxy-tri-methylene di-amine, and ether-alcohols having up to about 150 oxy-alkylene radicals in which each alkylene radical contains from 1 to 8 carbon atoms.

The ester dispersant may be a di-ester of succinic acid or an acidic ester, i.e. a partially esterified succinic acid; or a partially esterified polyhydric alcohol or phenol, i.e. an ester having free alcoholic or phenolic hydroxyl radicals. Mixtures of the above illustrated esters are likewise contemplated.

The ester dispersant may be prepared by one of several known methods as illustrated for example in U.S. Pat. No. 3,381,022.

Mannich base type dispersants such as those described in U.S. Pat. Nos. 3,649,229 and 3,798,165 may also be used in these compositions. Such Mannich base dispersants can be formed by reacting a high molecular weight, hydrocarbyl-substituted mono- or polyhydroxyl benzene (e.g. having a number average molecular weight of 1,000 or greater) with amines (e.g. polyalkyl polyamines, polyalkenyl polyamines, aromatic amines, carboxylic acid-substituted polyamines and the succinimide formed from any one of these with an olefinic succinic acid or anhydride) and carbonyl compounds (e.g. formaldehyde or para formaldehyde).

A particularly suitable dispersant is one derived from polyisobutylene substituted with succinic anhydride groups and reacted with polyethylene amines, e.g. tetraethylene pentamine, pentaethylene hexamine, polyoxyethylene and polyoxypropylene amines, e.g. polyoxypropylene diamine, trismethylolaminomethane and pentaerythritol, and combinations thereof.

Detergents

Metal-containing rust inhibitors and/or detergents are frequently used with ashless dispersants. Such detergents and rust inhibitors include oil-soluble mono- and dicrboxylic acids, the metal salts of sulfonic acids, alkyl phenols, sulfurized alkyl phenols, alkyl salicylates and naphthenates in neutral or basic form. Highly basic (or "over-based") metal salts, which are frequently used as detergents, appear particularly prone to promote oxidation of hydrocarbon oils containing them. Usually these metal-containing rust inhibitors and detergents are used in lubricating oil in amounts of from 0.01 to 10, e.g. 0.1 to 5, weight percent, based on the weight of the total lubricating composition.

Highly basic alkali metal and alkaline earth metal sulfonates are frequently used as detergents. They are usually produced by heating a mixture comprising an oil-soluble sulfonate or alkaryl sulfonic acid, with an excess of alkali metal or alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example, haloparaffins, olefins obtained by dehydrogenation of paraffins, polyolefin polymers produced from ethylene, propylene, etc. are all suitable. The alkaryl sulfonates usually contain from 9 to 70 or more carbon atoms, preferably from 16 to 50 carbon atoms per alkyl substituted aromatic moiety.

The alkali metal or alkaline earth metal compounds which may be used in neutralizing these alkaryl sulfonic acids to provide the sulfonates include the oxides and hydroxides, alkoxides, carbonates, carboxylates, sulfides, hydrosulfides, nitrates, borates and ethers of sodium, magnesium, calcium, strontium and barium. Examples are calcium oxide, calcium hydroxide, magnesium oxide, magnesium acetate and magnesium borate. As noted, the alkaline earth metal compound is used in excess of that required to complete neutralization of the alkaryl sulfonic acids. Generally, the amount ranges from 100 to 220 percent, although it is preferred to use at least 125 percent of the stoichiometric amount of metal required for complete neutralization.

Various other preparations of basic alkali metal and alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

Preferred alkaline earth sulfonate additives are magnesium alkyl aromatic sulfonate additives having a high total base number (TBN) as measured by ASTM 02896 of at least 250, more preferably ranging from 300 to 400, and calcium alkyl aromatic sultfonates having a TBN of at least 250, preferably 300–400.

Neutral metal sulfonates are frequently used as rust inhibitors. Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing alkaline earth metal, e.g. calcium, salts of mixtures of $C_8$–$C_{26}$ alkyl salicylates and phenates (U.S. Pat. No. 2,744,069) or polyvalent metal salts of alkyl salicylic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is useful at TBN levels of between 60 and 150. Included with the useful polyvalent metal salicylate and naphthenate materials are the methylene and sulfur bridged materials which are readily derived from alkyl substituted salicylic or naphthenic acids or mixtures of either or both with alkyl substituted phenols. Basic sulfurized salicylates and a method for their preparation are disclosed in U.S. Pat. No. 3,595,791. Such materials include alkaline earth metal, particularly magnesium, calcium, strontium and barium, salts of aromatic acids having the general formula:

$$HOOC\text{-}ArR^{10}OH\text{-}Z_w(ArR^{10}OH)r$$

where Ar is an aryl radical of 1 to 6 rings, $R^{10}$ is an alkyl group having from 8 to 50 carbon atoms, preferably 12 to 30 carbon atoms (optimally about 12), Z is a sulfur (—S—) or methylene (—$CH_2$—) bridge, w is a number from 0 to 4 and r is a number from 0 to 4.

Preparation of the overbased methylene bridged salicylate-phenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicylic acid of the general formula:

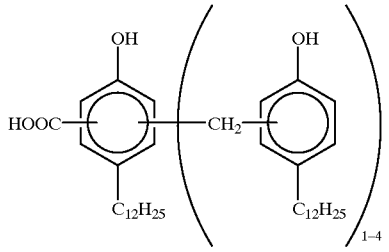

with a TBN of 60 to 150 is also useful.

Another type of basic metal detergent, the sulfurized metal phenates, can be considered a metal salt whether neutral or basic, of a compound typified by the general formula:

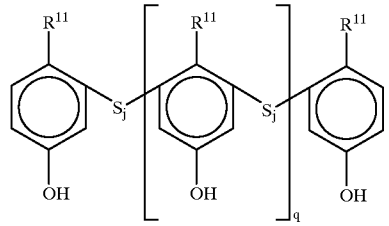

where j=1 or 2, q=0, 1 or 2 or a polymeric form of such a compound, where $R^{11}$ is an alkyl radical, j and q are each integers from 1 to 4, and the average number of carbon atoms in all of the R groups is at least about 9 in order to ensure adequate solubility in oil. The individual $R^{11}$ groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

Regardless of the manner in which they are prepared, the sulfurized alkyl phenols which are useful generally contain from 2 to 14 percent by weight, preferably 4 to 12 weight percent sulfur based on the weight of sulfurized alkyl phenol.

The sulfurized alkyl phenol may be converted by reaction with a metal-containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than the stoichiometric ratio, e.g. basic sulfurized metal dodecyl phenate has a metal content up to (or greater) than 100 percent in excess of the metal present in the corresponding normal sulfurized metal phenate. The excess metal is produced in oil-soluble or dispersible form (as by reaction with $CO_2$).

The detergents which may be included in the compositions of the present invention may optionally be borated in a known manner. Such boration provides the detergent with a measure of anti-weer activity.

It is preferred to use a combination of metal-containing detergents comprising calcium and magnesium salts or calcium, magnesium and sodium salts, as described above.

Antiwear Additives (including extreme pressure agents)

A wide variety of anti-wear additives may be included in the compositions or concentrates of the invention. For example, organic sulphides and polysulphides including especially dialkyl sulphides and polysulphides, e.g. dibutyl polysulphides, and dibenzyl sulphides and polysulphides, which may be substituted, e.g. with halogen, may be incorporated in the compositions or concentrates. Sulphurized esters, e.g. sulphurized methyl or isopropyl oleate and other sulphurized compounds, e.g. sulphurized olefins such as sulphurized diisobutylene, sulphurized tripropylene or sulphurized dipentene may also be added to the compositions. More complex sulphurized compounds such as sulphurized alkyl phenols and sulphurized terpenes and Diels-Alder adducts and sulphurized polymers, e.g. butadiene/butyl acrylate copolymers, may also be used as may sulphurized tall oil fatty acid esters. Esters of beta-thiodipropionic acid, e.g. butyl, nonyl, tridecyl or eicosyl esters may also be used.

Anti-wear additives in the form of phosphorus esters, e.g. di- and tri-alkyl, cycloalkyl or aryl phosphites, may also be used. Examples of such phosphites include dibutyl phosphite, dihexyl phosphite, dicyclohexyl phosphite, alkyl phenyl phosphites such as dimethylphenyl phosphite and mixed higher alkyl, e.g. oleyl, and alkyl phenyl, e.g. 4-pentyl phenyl phosphite. Phosphites based on polymers such as low molecular weight, polyethylenes and polypropylenes may also be used.

Preferred anti-wear additives for addition to the compositions and concentrates of the present invention are the dihydrocarbyl dithiophosphate metal salts. They also provide some antioxidant activity. The zinc salts are most commonly used in lubricating oils in amounts of 0.1 to 10, preferably 0.2 to 2, weight percent, based upon the total weight of the lubricating oil composition. Salts of other metals, e.g. barium and cadmium, can also be used. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols, secondary generally for importing improved antiwear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil-soluble salts of dihydrocarbyl esters of dithiophosphoric acids and may be represented by the following formula:

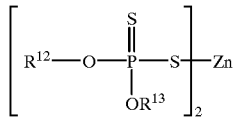

wherein $R^{12}$ and $R^{13}$ may be the same or different hydrocarbyl radicals containing from 1 to 18, preferably 2 to 12, carbon atoms and including radicals such as alkyl, alkenyl, aryl, aralkyl, alkaryl and cycloaliphatic radicals. Particularly preferred as $R^{12}$ and $R^{13}$ groups are alkyl groups of 2 to 8 carbon atoms. Thus, the radicals may, for example be ethyl, n-propyl, i-propyl, n-butyl, i-butyl, sec-butyl, amyl, s-hexyl, i-hexyl, i-octyl, decyl, dodecyl, octadecyl, 2-ethylhexyl, nonyl-phenyl, dodecyl-cyclohexyl, methylcyclopentyl, propenyl, butenyl, etc. In order to obtain oil solubility, the total number of carbon atoms (i.e. $R^{12}$ and $R^{13}$) in the dithiophosphoric acid generally should be about 5 or greater and preferably 8 or greater.

Borated derivatives of the aforesaid antiwear agents may also be included in the compositions or concentrates of the invention.

Additional Antioxidants

Additional antioxidants which are especially useful in lubricating oil compositions or concentrates are based on oil-soluble copper compounds, e.g. in the form of a synthetic or natural carboxylic acid salt. By "oil-soluble" is meant that the compound is oil-soluble or solubilized under normal blending conditions in the oil or concentrate. Examples of oil-soluble copper compounds include salts of $C_{10}$ to $C_{18}$ fatty acids such as stearic or palmitic acid; but unsaturated acids (such as oleic acid), branched carboxylic acids (such as naphthenic acids) of molecular weight from 200 to 500, dicarboxylic acids such as polyisobutenyl succinic acids, and synthetic carboxylic acids can all be used because of the acceptable handling and solubility properties of the resulting copper carboxylates.

Suitable oil-soluble copper dithiocarbamates have the general formula $(R^{14}R^{15}N.CS.S)pCu$; where p is 1 or 2 and $R^{14}$ and $R^{15}$ may be the same or different hydrocarbyl radicals containing from 1 to 18 carbon atoms each and including radicals such as alkyl, alkenyl, aryl, aralkyl, alkaryl and cycloaliphatic radicals. Particularly preferred as $R^{14}$ and $R^{15}$ groups are alkyl groups of 2 to 8 carbon atoms. Thus, the radicals may be, for example, ethyl, n-propyl, n-butyl, i-butyl, sec-butyl, amyl, sec-hexyl, i-hexyl, i-octyl, decyl, dodecyl, octadecyl, 2-ethylhexyl, nonyl-phenyl, dodecyl-phenyl, cyclohexyl, methylcyclopentyl, propenyl, butenyl, etc. In order to obtain oil solubility, the total number of carbon atoms (i.e. $R^{14}$ and $R^{15}$) generally should be about 5 or greater.

Copper salts of dithiophosphonic acids (the acid as described hereinbefore in relation to antiwear additives specifically as zinc salts), copper sulfonates, phenates and acetyl acetonates can also be used.

These antioxidants can be used in amounts such that, in the final lubricating composition, a copper concentration of from 5 to 500 ppm is present.

Other known oil-soluble or oil-ispersible, and preferably liquid, antioxidants may also be used in the compositions of the invention. Examples of such antioxidants include hindered phenols, which may contain sulphur, e.g. 4,4'-methylene bis (2,6di(t-butyl)phenol), 4,4'-thio bis (2,6-di(t-butyl)phenol) and p-alkylated hindered phenols; unhindered phenols which again may contain sulphur such as 2,2'-thio bis-(4-nonyl phenol) and 2,2'-methylene bis (4-nonylphenol); phenothiazine derivatives, e.g. those containing higher alkyl substituents such as dioctyl and dinonyl phenothiazines; substituted alpha and betanaphthyl amines such as phenyl beta-naphthylamine and its alkylated derivatives; other amino aryl compounds such as for example 4,4'-bis(secbutylamino) diphenylmethane; dithiocarbamates such as zinc, nickel, copper, or molybdenum dithiocarbamates; and phosphosulphurized olefins, e.g. phosphosulphurized pinene or styrene.

Corrosion Inhibitors and Metal Deactivators

Corrosion inhibitors which act by deactivating metal parts with which they come in contact and/or as sulphur scavengers can also be used in the compositions or concentrates of the invention. Examples of such agents include benzotriazole derivatives; thiadiazole compounds, e.g. 2,5dimercapto 1,3,4-thiadiazole; mercaptobenzothiazole compounds in the form of amine salts, sulphonamides, thiosulphonamides, and condensates of mercaptobenzothiazole with amines and formaldehyde; salicylaldehyde/diamine condensation products; dialkylphosphites, e.g. dioleyl or di-2-ethylhexyl phosphite; trialkyl and triarylphosphites, e.g. tris-(2-ethyl-hexyl), triphenyl or tri(4-nonylphenol) phosphites; and thiophosphonates such as triphenyl or trilauryl thiophosphonate or trilauryl tetrathiophosphonate.

Friction Modifiers and Fuel Economy Agents

Friction modifiers and fuel economy agents which are compatible with the other ingredients of the new compositions or concentrates may also be included. Examples of such materials are glyceryl monoesters and/or diesters of higher fatty acids, e.g. glyceryl mono-oleate and esters of long-chain polycarboxylic acids with diols, e.g. the butane diol ester of a dimerized unsaturated fatty acid, and oxazoline compounds.

Viscosity Index Improvers

Viscosity index improvers, or viscosity modifiers are typically polymers of number average molecular weight $10^3$ to $10^6$ —for example ethylene copolymers or polybutenes. Viscosity index improvers may be modified to have dispersant properties and suitable viscosity index improver dispersants for use in compositions of the invention are described in, for example, European Specification No 24 146 A.

(a) polymers comprising monomer units derived from a $C_4$ to $C_{24}$ unsaturated ester of vinyl alcohol or a $C_3$ to $C_{10}$ unsaturated mono-or dicarboxylic acid and an unsaturated nitrogen-containing monomer having 4 to 20 carbon atoms;

(b) polymers comprising monomer units derived from a $C_4$ to $C_{20}$ olefin and an unsaturated $C_3$ to $C_{10}$ mono-or dicarboxylic acid neutralised with an amine, a hydroxyamine or an alcohol; and (c) polymers of ethylene with a $C_3$ to $C_{20}$ olefin further reacted by grafting a $C_4$ to $C_{20}$ nitrogen-containing monomer thereon or by grafting an unsaturated acid onto the polymer backbone and then reacting the carboxylic acid groups with an amine, hydroxy amine, or alcohol. (The European specification also gives examples of various other additives which may be used in accordance with the present invention.) These viscosity index improvers also have dispersant properties, as is preferred in accordance with the invention, although viscosity index improvers without dispersant properties may be used if desired.

Preferred viscosity index improvers with dispersant properties for use in the compositions of the present invention comprise a polyolefin moiety to which is grafted an unsaturated carboxylic acid moiety, the carboxylic acid groups being reacted with an amine, hydroxyamine or alcohol.

Antioxidants may be evaluated using the sequence III E test (ASTM STP 315) which is a standard test used for assessing the oxidation resistance of lubricants and which is a more stringent version of the sequence III D test (ASTM STP 315M and ASTM STP 315). The sequence III method produces a result after 64 hrs of testing with an acceptable performance being a 375% or less increase in kinematic viscosity as measured at 40° C. after this period. The principle of this method is to observe oil thickening as a result of oxidation. When evaluating antioxidants for lubricants it is desirable to be able to use screening test methods which are quicker and easier to use than the Sequence III test. One such method which is commonly used is a thin film high temperature catalytic oxidation test performed using a DSC.

The invention will be further illustrated by means of the following Examples:

Diphenylamines

Table 1 lists details of the diphenylamines nominally of general structure II which were used in the following examples.

TABLE 1

| No. | Diphenylamine Trade Name | % N | $R^5$ and $R^6$ in general formula II |
|---|---|---|---|
| 1 | Pearsall OA 502 | 3.9 | $R^5 = R^6 = C_9$ |
| 2 | Naugalube 438L | 3.5 | $R^5 = R^6 = C_9$ |
| 3 | Vanlube SL | 4.2 | Mixture of $C_4$, $C_8$ and styryl |
| 4 | Naugalube 680 | 4.3 | Mixture of $C_4$, $C_8$ and styryl |
| 5 | Irganox L-57 | 4.7 | Mixture of t-butyl and t-octyl |
| 6 | Vanlube 848 | 4.7 | Mixture of t-butyl and t-octyl |
| 7 | Vanlube DND | 3.3 | $R^5 = R^6 = C_9$ |

DSC Test Method

The Differential Screening Calorimetry (DSC) test method used in the examples below is a thin film high temperature catalytic oxidation test. In the test the compounds to be tested for antioxidancy performance are added at the required treat rate to a sample of lubricant oil containing 500 ppm Fe and 2000 ppm Pb. This test sample (6–9 mg) is placed in the center of an aluminum DSC pan and inserted into a DuPont 990 High Pressure DSC. The cell of the DSC is then purged three times with 100 psi $O_2$ and then filled with $O_2$ at 250 psi. The cell is then heated at a programmed ramped rate of 100° C./min to the isothermal temperature of 190° C. After a period of time the test sample undergoes an exothermic oxidative reaction; this event and magnitude of the associated heat effects compared to the inert reference are monitored and recorded. The oxidation induction time (OIT; time to auto-oxidation) is the time at which the baseline intersects with a line tangent to the curve of the exothermal heat flow versus time scan. The OIT is reported in minutes. The magnitude of the OIT is an indication of the effectiveness of the compounds or compound mixtures under test as antioxidants; the larger the OIT the greater the antioxidant effect.

EXAMPLES 1 to 7

A control formulation of lubricating oil was tested with each of the diphenylamines listed in Table 1 with and without a molybdenum compound of the following general formula:

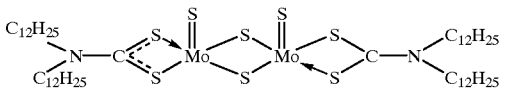

The control formulation in which the amines and the molybdenum compounds were tested comprised an Amoco Whiting base oil and an additive package which contained: a polyisobutene substituted succinimide dispersant, a low base number calcium sulphonate, a 400 total base number magnesium sulphonate, ZDDP and a demulsifier. The results are shown in Table 2.

TABLE 2

| Test | Diphenyl Amine | Concentration WT % DPA | Concentration WT % Mo Compound | OIT in minutes control or DPA only | OIT in minutes Control or DPA & Molybdenum compound |
|---|---|---|---|---|---|
| 1 | none | 0 | 0.5 | 1.8 | 2.7 |
| 2 | Pearsall OA 502 | 0.3 | 0.5 | 7.1 | 16.4 |
| 3 | Naugalube 438L | 0.3 | 0.5 | 6.2 | 21.0 |
| 4 | VanLube SL | 0.3 | 0.5 | 6.4 | 25.1 |
| 5 | Naugalube 680 | 0.3 | 0.5 | 7.5 | 18.2 |
| 6 | IrganoxL57 | 0.3 | 0.5 | 8.5 | 27.7 |
| 7 | VanLube 848 | 0.3 | 0.5 | — | 17.3 |

These results clearly show the synergistic antioxidant effect of combining a molybdenum compound of general formula I with a diphenylamine of general formula II. This is most notable from the result with Vanlube SL; if the effect was purely additive the expected result would be 7.3, that is the result of the calculation: the value of example 1 (with Mo compound)+value of example 4 (with amine only) the value of example 1 (without Mo compound). The actual result is 25.1, a 344% increase on the expected additive result.

EXAMPLES 8

A molybdenum compound, which is a commercially available material sold under the trade mark Molyvan 822 and is believed to have the nominal structure below, was evaluated with diphenylamines as listed in table 3 by means of the same DSC method. Examples 8 to 23 were carried out using the same base oil and additive package as in Examples 1–7. Examples 24 and 25 were carried out using a different base oil namely Petroscan Hydrocracked, with the same additive package. Again the results, which are shown in Table 3, show the synergistic effect observed with the combination of molybdenum compound of general formula I and diphenylamine of general formula II.

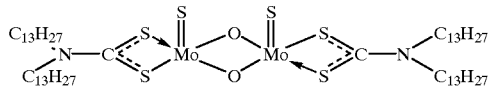

TABLE 3

| Test | Diphenyl Amine | Concentration WT % DPA | Concentration WT % Mo Compound | OIT in minutes control or DPA only | OIT in minutes Control or DPA & Mo compound |
|---|---|---|---|---|---|
| 8 | NONE | — | 0.15 | 1.8 | 2.1 |
| 9 | NONE | — | 0.25 | | 2.8 |
| 10 | NONE | — | 0.50 | | 2.9 |
| 11 | Pearsall OA 502 | 0.3 | 0.15 | 7.1 | 8.8 |
| 12 | Pearsall OA 502 | 0.3 | 0.25 | 7.1 | 11.9 |
| 13 | Vanlube DND | 0.3 | 0.15 | 6.9 | 8.1 |

TABLE 3-continued

| Test | Diphenyl Amine | Concentration WT % DPA | Mo Compound | OIT in minutes control or DPA only | Control or DPA & Mo compound |
|---|---|---|---|---|---|
| 14 | Vanlube DND | 0.3 | 0.25 | 6.9 | 13.9 |
| 15 | Vanlube DND | 0.3 | 0.50 | 6.9 | 17.1 |
| 16 | Naugalube 438L | 0.3 | 0.15 | 6.2 | 9.6 |
| 17 | Naugalube 438L | 0.3 | 0.25 | 6.2 | 11.1 |
| 18 | Vanlube SL | 0.3 | 0.15 | 6.4 | 8.1 |
| 19 | Vanlube SL | 0.3 | 0.25 | 6.4 | 8.5 |
| 20 | Naugalube 680 | 0.3 | 0.15 | 7.5 | 12.0 |
| 21 | Naugalube 680 | 0.3 | 0.25 | 7.5 | 9.3 |
| 22 | Irganox L-57 | 0.3 | 0.15 | 8.5 | 9.7 |
| 23 | Irganox L-57 | 0.3 | 0.25 | 8.5 | 12.1 |
| 24 | NONE | — | — | | 4.0 |
| 25 | Pearsall 0A 502 | 0.3 | 0.5 | 19.6 | 41.4 |

COMPARATIVE EXPERIMENT

A molybdenum compound of formula $MOS_2DTC_3$ wherein the DTC represents a dithiocarbamate group and the molybdenum is in oxidation state six was found to exhibit no synergistic antioxidant effect when used with diphenylamines of general formula II.

What is claimed is:

1. A lubricating oil additive comprising a combination of an oil-soluble molybdenum-containing compound of general formula I:

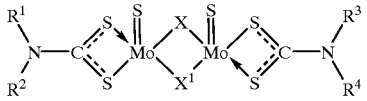

wherein $R^1$, $R^2$, $R^3$ and $R^4$ may be the same or different and each independently represent a $C_7$ to $C_{24}$ hydrocarbyl radical, X and $X^1$ may be the same or different and independently represent S or O, and the Mo is in oxidation state V or less; and at least one oil-soluble aromatic amine.

2. A lubricating oil additive as claimed in claim 1 wherein $R^1$, $R^2$, $R^3$ and $R^4$ each independently represent a $C_{10}$ to $C_{18}$ hydrocarbyl radical.

3. A lubricating oil additive as claimed in claim 2 wherein $R^1$, $R^2$, $R^3$ and $R^4$ are each independently $C_{12}$ or $C_{13}$ hydrocarbyl radicals.

4. A lubricating oil additive as claimed in any one of the preceding claims wherein $X=X^1=S$.

5. A lubricating oil additive as claimed in claim 1 wherein the oil-soluble aromatic amine is a diphenylamine.

6. A lubricating oil additive as claimed in claim 5 wherein the diphenylamine is a dialkylated diphenylamine.

7. A lubricating oil composition which comprises a lubricating oil and as antioxidant the lubricating oil additive as claimed in claim 1.

8. A lubricating oil composition as claimed in claim 7 wherein the lubricating oil additive is present at a concentration of 0.01 to 15% by weight based on total weight of the composition.

9. A lubricating oil composition as claimed in claim 7 wherein one or more of the following additives are also present: a dispersant, a detergent, an antiwear additive, a corrosion inhibitor, a metal deactivator, a friction modifier, a fuel economy agent, a viscosity index improver, and an antioxidant.

10. The lubricating oil of claim 8, wherein said lubricating oil additive is present at a concentration of about 0.1 to about 7% by weight.

11. A lubricating oil concentrate comprising a solvent and the lubricating oil additive of claim 1.

12. The lubricating oil concentrate of claim 11, comprising between about 2.5 and about 90% by weight of said lubricating oil additive.

13. The lubricating oil composition of claim 12, comprising between about 5 and about 75% by weight of said lubricating oil additive.

14. The lubricating oil concentrate of claim 11, wherein said solvent is selected from the group consisting of mineral oil and synthetic oil.

15. The lubricating oil concentrate of claim 11, wherein said concentrate further contains at least one additive selected from the group consisting of dispersants, detergents, antiwear additives, corrosion inhibitors, metal deactivators, friction modifiers, fuel economy agents, viscosity improvers and antioxidants.

16. A method for reducing oxidation in lubricating oils comprising, adding to said lubricating oils, an effective amount of the additive of claim 1.

* * * * *